US005820354A

United States Patent [19]

Wild et al.

[11] Patent Number: 5,820,354

[45] Date of Patent: Oct. 13, 1998

[54] CASCADED PROGRESSING CAVITY PUMP SYSTEM

[75] Inventors: Alan G. Wild, Woodstock; Kamran Z. Mirza, Springfield, both of Ohio; Sheldon S. L. Chang, Port Jefferson, N.Y.

[73] Assignee: Robbins & Myers, Inc., Dayton, Ohio

[21] Appl. No.: 746,432

[22] Filed: Nov. 8, 1996

[51] Int. Cl.[6] ..... F04B 3/00; F04B 23/00; F01C 1/30

[52] U.S. Cl. ..... 417/244; 417/248; 417/304; 417/440; 418/9; 418/83

[58] Field of Search ..... 417/244, 248, 417/309, 310, 440; 418/9, 48, 83

[56] References Cited

U.S. PATENT DOCUMENTS

| | | | |
|---|---|---|---|
| 2,691,482 | 10/1954 | Ungar | 418/9 |
| 3,535,058 | 10/1970 | Devine | 418/9 |
| 3,912,426 | 10/1975 | Tschirky | 418/48 |
| 3,976,400 | 8/1976 | Major | 417/248 |
| 3,999,901 | 12/1976 | Tschirky | 418/48 |
| 5,171,139 | 12/1992 | Underwood et al. | 418/48 |
| 5,472,319 | 12/1995 | Rohlfing et al. | 417/310 |
| 5,494,425 | 2/1996 | Stehr | 418/83 |

FOREIGN PATENT DOCUMENTS

| | | |
|---|---|---|
| 0561494 | 9/1993 | European Pat. Off. . |
| 2418967 | 10/1975 | Germany . |
| 4269391 | 9/1992 | Japan . |
| 2124305 | 2/1984 | United Kingdom . |

*Primary Examiner*—Charles G. Freay
*Attorney, Agent, or Firm*—Thompson Hine & Flory LLP

[57] ABSTRACT

At least two progressing cavity pumps or pump sections are connected in series. The flow volume rate of the second pump or pump section is less than the flow volume rate of the first pump or pump section. If there are more than two pumps or pumps sections, the flow volume rate of the third pump or pump section would be less than the flow volume rate of the second pump or pump section, and so on. The cascade arrangement of progressing cavity pumps can be achieved by interconnecting separate pump assemblies end to end. The cascade arrangement of progressing cavity pump sections can be achieved by the attachment of the rotor/stator pairs of each pump section in series with suitable universal mechanisms and housings. Such a cascade arrangement of progressing cavity pumps or pump sections allows and compensates for the compressibility of the gas in the two-phase or multi-phase fluid being pumped, especially in pumping operations requiring high differential pressures.

27 Claims, 2 Drawing Sheets

CASCADED PROGRESSING CAVITY PUMP SYSTEM

BACKGROUND

The present invention relates to helical gear pumps, and more particularly, to an arrangement of helical gear pumps in which the internal pressure distribution is evenly distributed throughout the pump arrangement.

A typical helical gear pump, or progressing cavity pump, comprises an externally threaded rotor co-acting with an internally helical threaded stator, where the stator has one more lead or start than the rotor. Pumps of this general type are typically built with a rigid metallic rotor and a stator which is formed from a flexible or resilient material such as rubber. The rotor is made to fit within the stator bore with an interference fit, i.e., there is a compressive fit between the rotor and stator. This compressive fit results in seal lines where the rotor and stator contact. These seal lines define or seal off definite cavities bounded by the rotor and stator surfaces. A complete set of seal lines define a stage of the pump, and the pressure capability of a pump of this type is a function of the number of stages.

In operation, the progressing cavity pump must work to overcome external conditions, such as pumping fluids through extensive lengths of piping, and therefore a differential pressure is created by the pump to counteract such external conditions. As the external pressure increases, the differential pressure must increase to overcome this pressure.

In order to increase the pressure capability of a progressing cavity pump it is common practice to increase the number of pump stages by adding to the rotor and stator length. It is also common knowledge that when a progressing cavity pump with multiple stages operates, the internal differential pressure is not evenly distributed across the entire rotor/stator length. Tests have shown that a disproportionate amount of the pressure is carried by the stages nearest the discharge end of the pump. This is because for pressure to be distributed in the pump, the pressure must be able to pass from one cavity to the next by leaking across the seal lines. This leakage across seal lines is also referred to as "slip." However, leakage can only occur when a certain minimum pressure is achieved to deflect the resilient rotor or stator member. Therefore, when the minimum pressure exists in one cavity to permit leakage across the seal lines forming the cavity, the pressure that leaks into the second cavity will probably not be enough to permit leakage into a third cavity, and so forth. This is why, at very low pressures, the entire differential pressure may be developed by the last stage only.

A significant problem with this disproportionate pressure distribution is that the excessive pressure in the discharge stages of the rotor/stator pair causes excessive heat to build up in the discharge stages of the stator, which commonly results in premature pump failure.

Furthermore, this disproportionate pressure distribution in progressing cavity pumps is exacerbated in applications where there is a significant amount of gas in the fluid being pumped. Typical progressing cavity pumps can be used to pump a wide range of fluids including fluids with solids in suspension, high viscosity fluids, and shear sensitive fluids; and since pumps of this type are positive displacement pumps, they can pump fluids with entrained gasses without vapor locking. However, since progressing cavity pumps generally have lower internal leakage values than other types of rotary positive displacement pumps, they are limited in their ability to handle high gas to liquid ratios where high differential pressures are required, due to the temperature limitations of the elastomeric stator material.

Fluids which are a combination of gas and liquid are typically called two phase fluids; and when the liquid phase of the gas and liquid fluid is a combination of different liquids, such as oil and water, the fluids are typically called multi-phase fluids. Multi-phase fluids create special problems for progressing cavity pumps due to the compressibility of the gas phase of the fluid.

The volume of the multi-phase fluid which enters the rotor/stator progressing cavities is determined by the pressure at the inlet to the cavities. Therefore, due to the increasing internal pressures towards the discharge end, as the multi-phase fluid progresses through the length of the rotor/stator pair, the gas will compress, reducing the total fluid volume. However, since the cavity volume remains constant, the disproportionate pressure distribution discussed above will be even more pronounced, resulting in exacerbated heat buildup in the latter stages of the pump. This occurs as a result of the Gas Laws which state that as the pressure increases the volume will decrease and the temperature will increase. Theoretically, if the volume of the gas is not allowed to decrease as it passes through the pump, and the pressure increases, the temperature will increase substantially. Tests have shown that this temperature increase does occur, but not to the extent indicated theoretically. The exacerbated heat build-up also occurs as a result of increased leakage across seal lines near the discharge end, which results in an increased flexing of the resilient rotor or stator member, which in turn adds to the head build-up in the rubber.

One known solution to this problem is to loosen the compressive fit between the rotor and stator evenly along the length of the rotor/stator pair, to increase the amount of internal leakage or slip from the progressing cavities. This loosened fit promotes better pressure distribution throughout the length of the rotor/stator pair; however, the loosened fit also reduces the total pressure capability of the pump, and can thus result in increased wear and reduced life of the rotor and stator.

Another recognized solution to the problem is to alter the geometry of the rotor and stator to provide a pump with progressing cavities which become smaller with their distance from the suction end. One such invention is disclosed in U.S. Pat. No. 2,765,114 to Chang, which discloses a cone shaped rotor and a cone shaped stator used to form a compressor. However, the tooling required to construct such a compressor is expensive.

Accordingly, a need exists for a progressing cavity pump arrangement which is able to pump two phase and multi-phase fluids, and especially where the gasses of the fluids comprise 50% or more of the total fluid volume at standard conditions, and which is not susceptible to excessive heat build-up at the discharge end(s) of the pump(s) due to insufficient internal pressure distributions.

SUMMARY OF THE INVENTION

The present invention provides at least two progressing cavity pumps or pump sections connected in series. The flow volume rate of the second pump or pump section is less than the flow volume rate of the first pump or pump section. If there are more than two pumps or pumps sections, the flow volume rate of the third pump or pump section would be less than the flow volume rate of the second pump or pump section, and so on.

The cascade arrangement of progressing cavity pumps can be achieved by interconnecting separate pump assemblies end to end. The cascade arrangement of progressing cavity pump sections can be achieved by the attachment of the rotor/stator pairs of each pump section in series with suitable universal mechanisms and housings. Such a cascade arrangement of progressing cavity pumps or pump sections allows and compensates for the compressibility of the gas in the two-phase or multi-phase fluid being pumped.

"Flow volume rate" is the volume of the fluid passing through a rotor/stator pair or through a progressing cavity pump per unit time. Flow volume rate can be modified by adjusting the progressing cavity sizes in the rotor/stator pair or by adjusting the speed in which the rotor turns inside the stator bore. The flow volume rate can also be modified by a combination of the above adjustments.

In a preferred embodiment, the intermediate chambers or channels interconnecting the pumps or rotor/stator pairs include heat transfer mechanisms such as cooling fins or "heat-sinks" to assist in the dissipation of heat from the multiphase fluid being pumped. Additionally the use of a by-pass valve permits the bypass of a portion of the fluid being pumped during start-up until the desired system pressures are achieved and stable flow exists.

DETAILED DESCRIPTION

Figure 1:
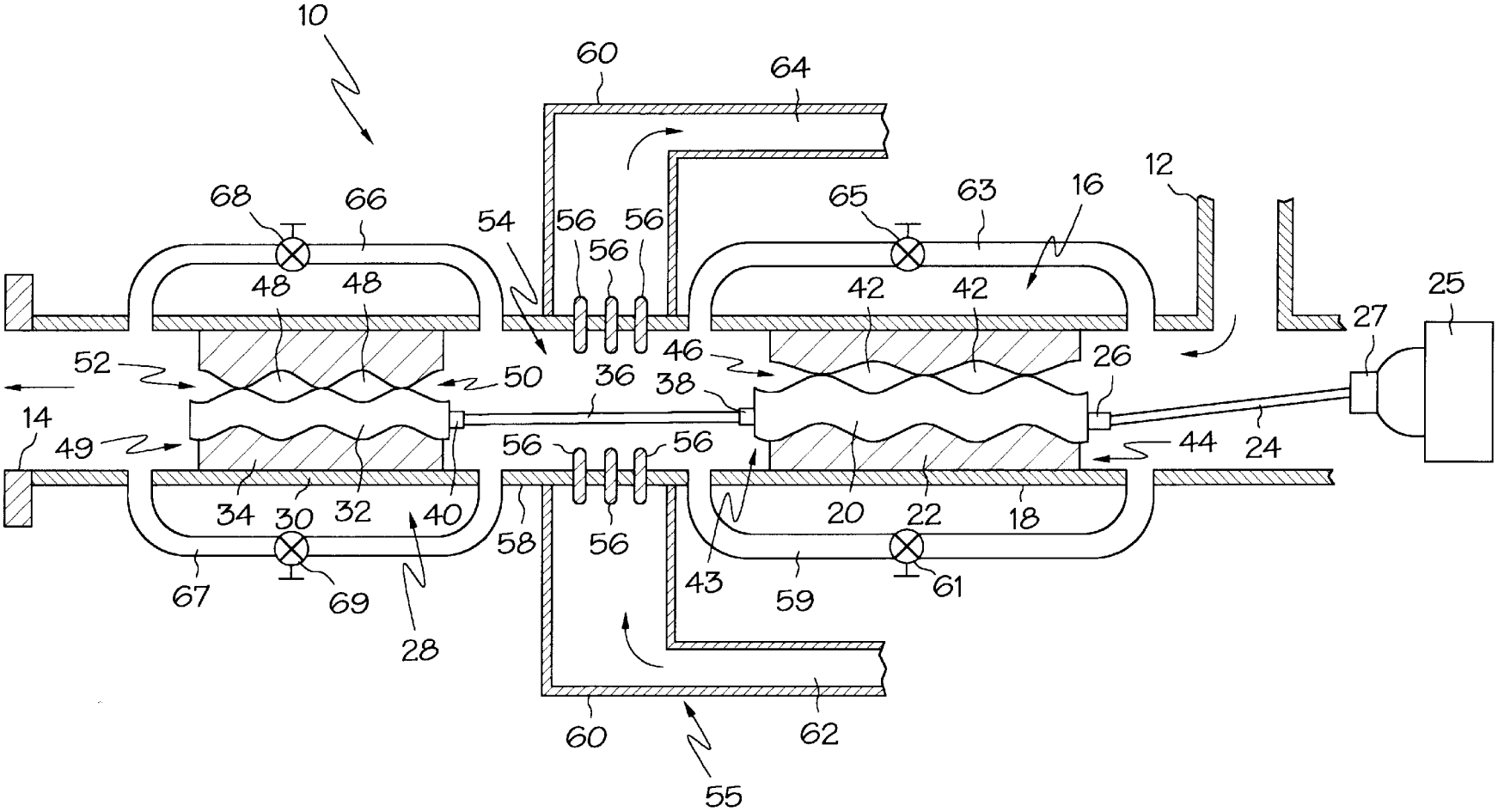
FIG. 1 is a longitudinal cross-sectional view of an embodiment of the invention, depicting a progressing cavity pump having multiple rotor/stator pairs.

As shown in FIG. 1, a cascade progressing cavity pump 10 includes a suction chamber 12 and a discharge port 14. The pump 10 has a first pump section 16 which includes a stator tube 18, a single lead helical screw or rotor 20, and a double lead helical nut, or stator 22; the stator 22 being mounted within the stator tube 18. The rotor 20 is driven by a drive shaft 24 which is coupled to the rotor by a universal joint 26 as is commonly known in the art. The drive shaft is driven by a drive motor 25, coupled to the drive shaft 24 by a universal joint 27.

The pump 10 has a second pump section 28 which includes a stator tube 30, a single lead rotor 32, a double lead stator 34; the stator 34 being mounted within the stator tube 30. The rotor 32 is driven by a connecting rod 36 which is coupled between the rotors 20,32 by respective universal joints 38, 40 as is commonly known in the art. The rotors 20,32 are preferably metallic and rotate eccentrically inside the stators 22,34, respectively, which are preferably formed from resilient and flexible elastomeric material.

As is further shown in FIG. 1, as the rotor 20 turns inside the stator 22 in the first pump section 16, progressing cavities 42 are formed which progress from the suction end 44 of the first rotor/stator pair 43 to the discharge end 46 of the first rotor/stator pair 43. Likewise, as the rotor 32 turns inside the stator 34 in the second pump section 28, progressing cavities 48 are formed which progress from the suction end 50 of the second rotor/stator pair 49 to the discharge end 52 of the second rotor/stator pair 49. In one revolution of each rotor, two separate sets of cavities are formed in each respective rotor/stator pair 43, 49; one set of cavities opening at exactly the same rate as the second set of cavities is closing. This results in a predictable, pulsationless flow. The pitch length of the stators 22,34 are twice that of the rotors 20,32, and in the present embodiment, the rotor/stator pair combinations are identified as 1:2 profile elements, which stands for the one lead on the rotor and the two leads on the stator. As one of ordinary skill in the art will recognize, the present invention can also be for use with more complex progressing cavity pumps such as 9:10 designs where the rotor has nine leads and the stator has ten leads (as is commonly known in the art, any combination is possible so long as the stator has one additional lead than the rotor).

The compressive fit between the rotors and their corresponding elastomeric stators results in a series of seal lines where the rotors contact the stators. The seal lines assure separation of the individual cavities progressing through the pump sections with each revolution of the rotors. The set of seal lines formed in one stator pitch length constitutes one stage. The differential pressure capability of the progressing cavity pump sections is determined by the number of stages a pump section has. Thus, a two stage pump section has twice the pressure capability of a single stage pump section, a three stage pump has three times the pressure capability of a single stage pump section, etc.

"Flow volume rate" is the volume of fluid passing through a progressing cavity pump or a rotor/stator pair of the progressing cavity pump per unit time. Flow volume rate can be modified by adjusting the sizes of the rotor and stator, thus adjusting the average cavity volumes in the rotor/stator pair. Flow volume rate can also be modified by adjusting the speed in which the rotor turns. The flow volume rate can also be modified by a combination of the above adjustments.

In the cascade pump arrangement of FIG. 1, the rotors 20, 32 are turning at the same speed in their respective pump sections 16, 28. The volume in each of the cavities 42 in the first pump section 16 is greater than the volume in each of the cavities 48 in the second pump section 28. Therefore, the first pump section 16 has a greater flow volume rate than the second pump section 28. Consequently, the smaller volume of the cavities 48 in second pump section 28 near the discharge end of the pump 10 accounts for the increased pressure nearer the discharge port 14 of the pump, and therefore the increase in temperature near the discharge end of the pump is substantially lessened. This is illustrated by the universal gas law:

$$P \times V = n \times R \times T \qquad \text{(Eq. 1)}$$

(where P is the pressure in a progressing cavity, V is the volume of the progressing cavity, n is the quantity of gas in the progressing cavity, R is the gas constant and T is the temperature of the gas). As shown in the Universal Gas Law equation, the temperature T is proportional to the pressure P times the volume V; and in the present invention, the decreased volume of the progressing cavities 48 in the second pump section 28 essentially counteracts the reduced volume due to increased pressure in this section. Accordingly, the smaller flow volume rate in the second pump section (nearest the discharge end of the pump) results in a better matched flow and a decreased temperature T in the discharge end of the pump.

Although the present embodiment utilizes two progressing cavity pump sections in a cascade arrangement, it is within the scope of the invention to utilize more than two progressing cavity pump sections; the flow volume rate of the third pump section being less than the flow volume rate of the second pump section, the flow volume rate of the fourth pump section (if utilized) being less than the flow volume rate of the third pump section, and so on. Such a cascade arrangement of progressing cavity pump sections allows and compensates for the compressibility of the gas in the two-phase or multi-phase fluid being pumped. The amount by which the flow volume rate differs between one pump section and the next will depend upon the total differential pressure across the pumping system, the temperature of the fluid at the pump inlet, the gas to liquid ratio of the fluid being pumped and the oil to water ratio of the fluid being pumped.

As is further shown in FIG. 1, an intermediate sump chamber 54 is present between the first pump section 16 and the second pump section 28, and a cooling system 55 is installed onto the pump 10 between the first pump section 16 and the second pump section 28 for cooling the fluids present within the intermediate sump chamber 54. The cooling system 55 includes a plurality of heat-sinks or cooling fins 56 extending through the pump wall 58 and into the intermediate sump chamber 54; and an annular cooling jacket 60, having a coolant inlet port 62 and a coolant outlet port 64, mounted to the outer surface of the pump wall such that the jacket 60 surrounds the fins 56 extending through the wall. The fins 56 act to absorb heat from the fluid and gas being pumped through the intermediate sump chamber 56, and the coolant flowing over the fins 56 acts to absorb heat from the fins. Accordingly, the fins 56 and the cooling jacket 60 operate to dissipate a portion of the heat from the fluid being pumped through the intermediate sump chamber.

Typical coolants such as water or air are preferred, however, it is within the scope of the invention to utilize any similar liquid or gas coolant sufficient for the purpose described above. Accordingly, a pump (not shown) for pumping a liquid coolant from a liquid coolant source (also not shown) through the jacket 60 is included with the cooling system 55; or a fan (not shown) for circulating a gaseous coolant from a gaseous coolant source (also not shown) through the jacket 60 is included with the cooling system 55. It should also be apparent to one of ordinary skill in the art that the cooling jacket could be removed and the heat from the cooling fins merely be dissipated into the pump housing.

If more than two pump sections are utilized, it is within the scope of the invention to install similar cooling systems between any or all of such pump sections; and it is also within the scope of the present invention to install a similar cooling system near the discharge port 14 for dissipating heat from the fluid being discharged from the pump. Furthermore, it is within the scope of the present invention to provide channels (not shown) within the fins 56, and in fluid communication with the coolant source, to facilitate the flow of the coolant through the fins and to thus provide a more direct and efficient cooling system.

As is further shown in FIG. 1, bypass channel 66, having a bypass valve 68, provides fluid communication between the intermediate chamber 54 and the discharge port 14 during start-up of the pump 10; and bypass channel 63, having a bypass valve 65, provides fluid communication between the suction port 12 and the intermediate chamber 54 during start-up of the pump 10. Progressing cavity pumps used in multiphase pumping applications are typically used to reduce wellhead or satellite pressures. Therefore, when the pump 10 is initially started, it may be started slowly with most of the fluid flow bypassed around the pump, through the bypass channels 63, 66. As the pump system speed increases more of the fluid passes through the pumping elements and less is bypassed, resulting in reduced wellhead pressures. When the pumping system is pumping at a rate that equals the produced flow from the well(s) then the wellhead pressure is reduced and increased production from the well will be typically increased.

Additional bypass channel 67, having a bypass valve 69, providing fluid communication between the intermediate chamber 54 and the discharge port 14; and additional bypass channel 59, having a bypass valve 61, providing fluid communication between the suction port 12 and the intermediate chamber 54 may also be provided. The additional bypass channels 59, 67 are installed below the pump centerline, preferably at the lowest part of the housing. These bypass channels 59, 67 are useful in applications where the gas to liquid ratio of the fluid is high, on the order of 98% or more, and the gas is dry. The bypass channels 59, 67 can be used to recirculate small amounts of the fluid in order to ensure adequate lubrication of the stator's 22, 34 elastomer surfaces.

Figure 2:
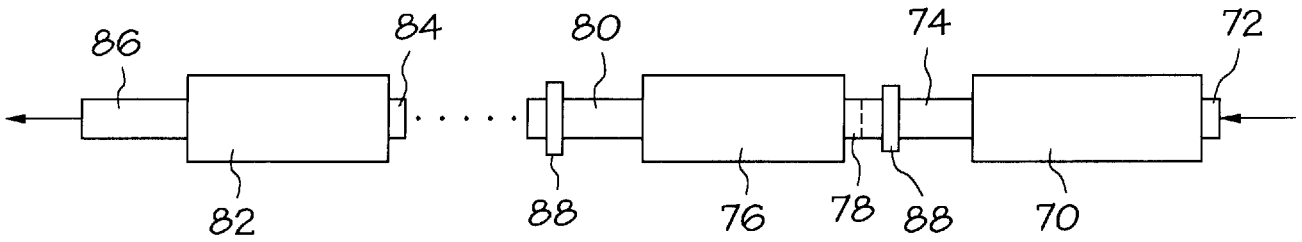
FIG. 2 is a block diagram of an embodiment of the invention, depicting a multitude of progressing cavity pumps connected in series.

As shown in FIG. 2, the desired effects of utilizing a progressing cavity pump having multiple pump sections where the flow volume rate capacities of the pump sections decrease with the distance from the suction port (as shown in FIG. 1 and described above), can be also realized by connecting a plurality of progressing cavity pumps in series. A first progressing cavity pump 70 operating at a flow volume rate of A, has a suction port 72 and a discharge port 74; a second progressing cavity pump 76 operating at a flow volume rate of B, has a suction port 78 and a discharge port 80; and an Nth progressing cavity pump 82 operating at a flow volume rate of X, has a suction port 84 and a discharge port 86. The flow volume rate B is smaller than the flow volume rate A; and likewise, the flow volume rate X is smaller than the flow volume rate of B and is also smaller than the flow volume rate of X−1. Cooling systems 88 are provided between the pumps to further facilitated the heat dissipation in the fluid/gas being pumped.

Figure 3:
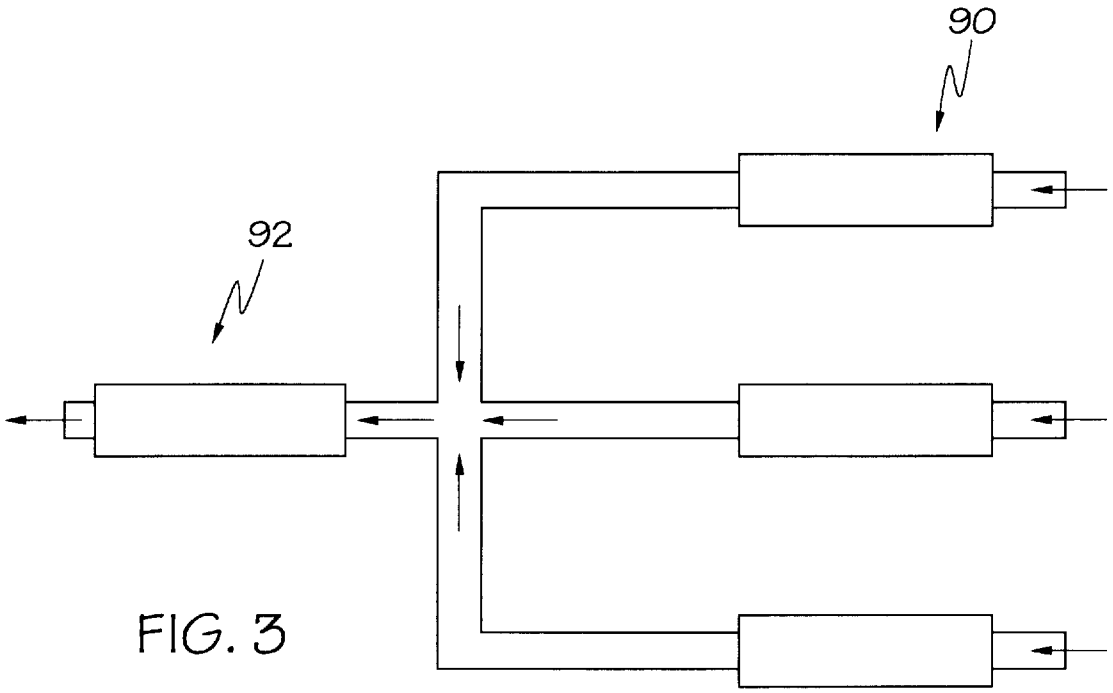
FIG. 3 is a block diagram of an embodiment of the invention, depicting a group of progressing cavity pumps connected in parallel and feeding another progressing cavity pump.

As shown in FIG. 3, the present invention is also useful in applications where a group of progressing cavity pumps 90 or pump assemblies, operating in parallel and having a total flow volume rate of $\alpha$, feed a single progressing cavity pump 92 or pump assembly, having a flow volume rate of $\beta$; where the flow volume rate $\beta$ is smaller than the flow volume rate $\alpha$. It should be apparent to one of ordinary skill in the art the single pump or pump assembly 92 can also be a group of pumps or pump assemblies operating in parallel, and having a total flow volume rate of $\beta$. Likewise, the group of progressing cavity pumps or pump assemblies 90 can be a single pump having a flow volume rate of $\alpha$.

EXAMPLES

In Example I, a mathematical representation of a single section progressing cavity pump (not utilizing the present invention) is presented for comparison purposes; in Example II, a mathematical representation of a triple section progressing cavity pump of the present invention is presented; and in Example III, a mathematical representation of a triple section progressing cavity pump of the present invention utilizing a cooling system of the present invention is presented. In order to set up the following examples, however, it is first beneficial to describe the derivation of the mathematical theory used in the three examples first.

| Mathematical Theory | | |
|---|---|---|
| $p_i$, $T_i$ | = | inlet pressure and temperature of a progressing cavity pump |
| $p_o$, $T_o$ | = | outlet pressure and temperature of a progressing cavity pump |
| R | = | universal gas constant |
| $V_c$ | = | progressing cavity volume |
| $V_x$ | = | in-rush volume as a cavity is opened at the pressure or outlet end |
| C | = | thermal capacities of the fluid/gas being pumped |
| $U_i$, $U_o$ | = | Internal energies of the fluid/gas at the inlet and at the outlet, respectively. |

Assume that leakage flow across the sealing lines is negligible. As each cavity progresses to the discharge end (the pressure end) and opens, there is a backward inrush of fluid to equalize the cavity fluid pressure with the outlet pressure. Therefore, conservation of mass requires that $$\frac{p_i V_c}{RT_i} + \frac{p_o V_x}{RT_o} = \frac{p_o V_c}{RT_o} \quad \text{(Eq. 2)}$$

and conservation of energy requires that $$\frac{p_i V_c U_i}{RT_i} + \frac{p_o V_x U_o}{RT_o} + W = \frac{p_o V_c U_o}{RT_o} \quad \text{(Eq. 3)}$$

where $$U_i = CT_i \quad \text{(Eq. 4)}$$

$$U_o = CT_o \quad \text{(Eq. 5)}$$

$$W = V_X P_o \quad \text{(Eq. 6)}$$

W is the work done by the gas at compression end to push back $V_X$ into the opened cavity.

Equation (2) can be reduced to $$T_o/T_i = p_o/p_i(1 - V_x/V_c) \quad \text{(Eq. 7)}$$

Substituting equation (4), equation (5) and equation (6) into equation (3) gives $$a(V_c + bV_x) + bV_x = abV_c \quad \text{(Eq. 8)}$$

where a=C/R, and $b = p_o/p_i$. Solving equation (8) gives $$\frac{V_x}{V_c} = \frac{a(b-1)}{b(1+a)} \quad \text{(Eq. 9)}$$

$$\frac{T_o}{T_i} = \frac{b(b + ab - ab + a)}{b(1+a)} = \frac{b+a}{1+a} \quad \text{(Eq. 10)}$$

In deriving equation (10), four factors have been ignored:

(i) Part of the gaseous compression heat is conducted away by the fluid and also by the mechanical parts;

(ii) There is a finite time for back rush of the fluid (oil/gas mixture), and the cavity sealing line has moved forward during this time. The value of $V_X$ is reduced;

(iii) There is some leakage along the sealing lines, and $V_X$ is increased to account for the leakage; and (iv) Friction and viscous friction contribute to the heat developed.

Factors (i) and (ii) tend to decrease $T_o$. Factors (iii) and (iv) tend to increase $T_o$. Since the factors (i) and (ii) are likely to be more dominant, $T_o$. as predicted by equation (10), can be substantially higher than the actually measured $T_o$.

The ratio C/R is given by the kinetic theory of gas, and depends only on the number of atoms in a gas molecule:

| No. of atoms | C/R |
|---|---|
| 1 | 1.5 |
| 2 | 2.5 |
| 3 or more | 3.0 |

Therefore, based upon the above mathematical model, the following examples can be presented.

Example 1

Control—One Progressing Cavity Pump Section

An oil/gas mixture to be pumped is 200 gallons per minute ("GPM") of gas and 10 GPM of oil. Examination of the gas composition shows that 50% of the composition has two atoms per molecule while the remainder of the composition has three or more atoms per molecule. The suction pressure and temperature are $p_i$=50 psia and $T_i$=27° C. respectively. The output pressure is $p_o$=400 psia.

The C/R ratio is a =2.5 ×0.5 +3.0 ×0.5 =2.75

Therefore, the outlet temperature $T_o$, is calculated as:

$$T_o = (273 + 27) + \frac{8 + 2.75}{1 + 2.75} = 860° \text{ K.} = 587° \text{ C.}$$

Hydro-Power =210×350/1714.3=42.9 H.P.

Example 2

Three Progressing Cavity Pump Sections in Cascade

In this example, assume that the inlet and outlet temperatures for the first pump section are $T_i$ and $T_2$ respectively, and the inlet and outlet pressures of the first pump section are $p_i$ and $p_2$ respectively. Assume that the inlet and outlet temperatures for the second pump section are $T_2$ and $T_3$ respectively (this assumes that the outlet temperature of the first pump section equals the inlet temperature of the second pump section), and the inlet and outlet pressures of the second pump section are $p_2$ and $p_3$ respectively (this assumes that the outlet pressure of the first pump section equals the inlet pressure of the second pump section). Finally, assume that the inlet and outlet temperatures for the third pump section are $T_3$ and $T_4$ respectively (this assumes that the outlet temperature of the second pump section equals the inlet temperature of the third pump section), and the inlet and outlet pressures of the third pump section are $p_3$ and $p_4$ respectively (this assumes that the outlet pressure of the second pump section equals the inlet pressure of the third pump section). Accordingly:

First Section $p_i/p_o = p_1/p_2$=50/100 psi

Second Section $p_i/p_o = p_2/p_3$ =100/200 psi

Third Section $p_i/p_o = p_3/p_4$=200/400 psi $$\frac{T_2}{T_1} = \frac{2 + 2.75}{1 + 2.75} = 1.267$$

$T_3/T_1 = 1.267^2 = 1.605$ $T_4/T_1 = 1.267^3 = 2.034$

The gas volumes being pumped by the second and third stages are respectively:

200×1.267×½=126.7 GPM 126.7×1.267×½=80.3 GPM

Hydro Pwr =(210×50+136.7×100+90.3×200)/1714.3= 24.6 H.P.

The final temperature is $T_4=300\times2.034=610°$ K.=337° C.

Example 3

Cooling fins and coolant means are used to dissipate 50% of the compression heat in Example 2. Other conditions remain unchanged.

$T_2/T_1=½\ (1+1.267)=1.134$ $T_3/T_1=(1.134)^2=1.286$ $T_4/T_1=(1.134)^3=1.458$

The gas volumes being pumped by the second and third stages are, respectively:

200×1.134×½=113.4 GPM 113.4×1.134×½=64.3 GPM

Hyd. Pwr=(210×50+123.4×100+74.3×200)/1714.3=22 H.P.

Final temperature $=T_4=300\times1.458=437.4°$ K.=164.4° C.

The results are summarized in the following Table:

| Pump | Heat Dissipation | Initial | and Final Temp. | Motor H.P. |
|---|---|---|---|---|
| 1-Section | 0 | 27° C. | 587° C. | 53.6 |
| 3-Section | 0 | 27° C. | 337° C. | 30.8 |
| 3-Section with Cooling System | 50% | 27° C. | 164° C. | 27.5 |

In conclusion, effective heat dissipation can be easily introduced into the multi-section progressing pump design. Furthermore, in assembling the pump, cooling systems can be introduced between the pump sections such that heat in the oil/gas mixture can be dissipated therefrom. It is also noted that effective cooling reduces the required motor power substantially. This spared electrical power can be used to facilitate the liquid or forced-air coolant flow over the pump housing and/or cooling fins.

Having described the invention in detail and by reference to the drawings, it will be apparent that modification and variations are possible without departing from the scope of invention as defined in the following claims.

What is claimed is:

1. A progressing cavity pump having a suction port and a discharge port, comprising:

a first pump section capable of operating at a first flow volume rate, said first pump section including an inlet in fluid communication with said suction port, an outlet, a rotor in the form of a helical gear with at least one lead, and a stator having an internal bore in the form of a helical gear with one more lead than said rotor of said first pump section; and a second pump section capable of operating at a second flow volume rate, said second pump section including an inlet in fluid communication with said outlet of said first pump section, an outlet in fluid communication with said discharge port, a rotor in the form of a helical gear with at least one lead, and a stator having an internal bore in the form of a helical gear with one more lead than said rotor of said first pump section;

said second flow volume rate being less than said first flow volume rate.

2. The progressing cavity pump of claim 1, further comprising:

an intermediate chamber in fluid communication with said outlet of said first pump section and in fluid communication with said port of said second pump section.

3. The progressing cavity pump of claim 2, further comprising a cooling system for cooling fluid in said intermediate chamber.

4. The progressing cavity pump of claim 3, wherein said cooling system includes heat transfer components extending within said intermediate chamber.

5. The progressing cavity pump of claim 4, wherein said heat transfer components include cooling fins, and said cooling system further includes a means for continuously flowing a coolant over a portion of said cooling fins to dissipate heat absorbed from said fluid by said cooling fins.

6. The progressing cavity pump of claim 1, further comprising a cooling system, including heat transfer components extending within said discharge port for cooling fluids in said discharge port.

7. The progressing cavity pump of claim 6, wherein said heat transfer components include cooling fins, and said cooling system further includes a means for continuously flowing a coolant over a portion of said cooling fins to dissipate heat absorbed from said fluid by said cooling fins.

8. The progressing cavity pump of claim 2, further comprising:

a bypass channel in fluid communication with said intermediate chamber and said discharge port; and a valve for controlling the flow of fluids and gasses through said bypass channel;

wherein said bypass channel provides a fluid bypass between said intermediate chamber and said discharge port when said valve is open.

9. The progressing cavity pump of claim 2, further comprising:

a bypass channel in fluid communication with said intermediate chamber and said suction port; and a valve for controlling the flow of fluid through said bypass channel;

wherein said bypass channel provides a fluid bypass between said intermediate chamber and said suction port when said valve is open.

10. The progressing cavity pump of claim 2, further comprising:

a bypass channel in fluid communication with said intermediate chamber and said discharge port, said bypass channel being mounted on the pump below a horizontal centerline of the pump; and a valve for controlling the flow of fluid through said bypass channel;

wherein said bypass channel provides a fluid bypass between said intermediate chamber and said discharge port when said valve is open.

11. The progressing cavity pump of claim 2, further comprising:

a bypass channel in fluid communication with said intermediate chamber and said suction port, said bypass channel being mounted on the pump below a horizontal centerline of the pump; and a valve for controlling the flow of fluid through said bypass channel;

wherein said bypass channel provides a fluid bypass between said intermediate chamber and said suction port when said valve is open.

12. The progressing cavity pump of claim 1 wherein said rotor of said first section is coupled to said rotor of said second pump section such that said rotor of said first section and said rotor of said second section turn at substantially the same speed.

13. The progressing cavity pump of claim 12, wherein:

said rotor of said first pump section is positioned within said internal bore of said stator of said first pump section to form a plurality of cavities bounded by said rotor of said first pump section and said stator of said first pump section, said plurality of cavities of said first pump section having a first average volume;

said rotor of said second pump section is positioned within said internal bore of said stator of said second pump section to form a plurality of cavities bounded by said rotor of said second pump section and said stator of said second pump section, said plurality of cavities of said second pump section having a second average volume; and said first average volume being larger than said second average volume.

14. A progressing cavity pump comprising:

a stator tube having a suction port and a discharge port; and a plurality of pump sections mounted longitudinally end-to-end within said stator tube, each of said pump sections capable of operating at a flow volume rate, and each of said pump sections including an inlet, an outlet, a rotor in the form of a helical gear with at least one lead, and an annular stator having an internal bore in the form of a helical gear with one more lead than said rotor;

a flow volume rate of one of said pump sections nearer said discharge port being less than the flow volume rate of one of said pump sections further from said discharge port.

15. The progressing cavity pump of claim 14, wherein a flow volume rate of one of said pump sections nearest said discharge port being less than a flow volume rate of one of said pump sections nearest said suction port.

16. The progressing cavity pump of claim 14, wherein said flow volume rates decrease with the distance from said suction port.

17. The progressing cavity pump of claim 14, further comprising at least one intermediate chamber disposed between a longitudinally adjacent pair of said pump sections.

18. The progressing cavity pump of claim 17, further comprising a cooling system, having at least one heat transfer component extending within said intermediate chamber.

19. The progressing cavity pump of claim 18, wherein said heat transfer component is a cooling fin, and said cooling system further includes a means for continuously flowing a coolant over a portion of said cooling fin to dissipate heat from said cooling fin.

20. The progressing cavity pump of claim 17, further comprising:

a bypass channel in fluid communication with said intermediate chamber and said discharge port; and a valve for controlling the flow of fluid through said bypass channel;

wherein said bypass channel provides a fluid bypass around said pump sections positioned between said intermediate chamber and said discharge port when said valve is open.

21. The progressing cavity pump of claim 17, further comprising:

a bypass channel in fluid communication with said intermediate chamber and said suction port; and a valve for controlling the flow of fluid through said bypass channel;

wherein said bypass channel provides a fluid bypass around said pump sections positioned between said intermediate chamber and said suction port when said valve is open.

22. The progressing cavity pump of claim 17, further comprising:

a bypass channel in fluid communication with said intermediate chamber and said discharge port, said bypass channel being mounted on the pump below a horizontal centerline of the pump; and a valve for controlling the flow of fluid through said bypass channel;

wherein said bypass channel provides a fluid bypass around said pump sections positioned between said intermediate chamber and said discharge port when said valve is open.

23. The progressing cavity pump of claim 17, further comprising:

a bypass channel in fluid communication with said intermediate chamber and said suction port, said bypass channel being mounted on the pump below a horizontal centerline of the pump; and a valve for controlling the flow of fluid through said bypass channel;

wherein said bypass channel provides a fluid bypass around said pump sections positioned between said intermediate chamber and said suction port when said valve is open.

24. A progressing cavity pump system comprising:

at least two progressing cavity pumps coupled together in series;

each of said pumps operating at a flow volume rate, and having a suction port and a discharge port;

said discharge port of a first pump in said series being in fluid communication with said suction port of a second pump in said series; and said flow volume rate of said first pump being greater than said flow volume rate of said second pump.

25. The progressing cavity pump system of claim 24, further comprising:

an intermediate channel disposed between said discharge port of said first pump and said suction port of said second pump, for providing fluid communication between said discharge port of said first pump and said suction port of said second pump.

26. The progressing cavity pump system of claim 25, further comprising a cooling system mounted to said intermediate channel for dissipating heat from fluid entering said intermediate channel.

27. The progressing cavity pump system of claim 24, further comprising:

at least a third progressing cavity pump operating at a flow volume rate, and having a suction port and a discharge port;

said discharge port of said third pump being in fluid communication with said discharge port of said first pump and in fluid communication with said suction port of said second pump, such that said first and said third pumps are coupled to each other in parallel;

said flow volume capacity of said second pump being less than a combination of said flow volume capacity of said first pump and said flow volume capacity of said third pump.

* * * * *